United States Patent [19]

Weaver

[11] 4,403,735

[45] Sep. 13, 1983

[54] FLUID OPERATED NOZZLES FOR GENERATION OF VIBRATIONS IN LIQUIDS

[75] Inventor: Colin R. Weaver, Warwickshire, England

[73] Assignee: Rolls Royce Limited, London, England

[21] Appl. No.: 174,143

[22] Filed: Jul. 31, 1980

Related U.S. Application Data

[63] Continuation of Ser. No. 940,283, Sep. 7, 1978, abandoned.

[30] Foreign Application Priority Data

Sep. 15, 1977 [GB] United Kingdom ..... 38503/77

[51] Int. Cl.[3] ..... B01F 5/18; B01F 11/02

[52] U.S. Cl. ..... 239/1; 4/491; 116/137 R; 134/102; 134/195; 239/556

[58] Field of Search ..... 239/461, 463, 487, 488, 239/490, 543, 548, 556, 568, 404, 1, 4; 366/167, 173, 176; 134/102, 166 R, 198, 199; 417/171, 193; 210/512.1, 512.2; 4/491, 492, 542, 543, 544; 137/592; 128/365, 369, 370; 116/137 R

[56] References Cited

U.S. PATENT DOCUMENTS

| | | | |
|---|---|---|---|
| 1,840,453 | 1/1932 | Keith | 239/487 X |
| 3,515,093 | 6/1970 | Greene | 116/137 R |
| 3,744,723 | 7/1973 | Davis | 239/543 |
| 4,116,383 | 9/1978 | Johnson | 239/406 X |

FOREIGN PATENT DOCUMENTS

| | | | |
|---|---|---|---|
| 2151074 | 4/1972 | Fed. Rep. of Germany | 239/404 |
| 1475307 | 6/1977 | United Kingdom . | |

*Primary Examiner*—Andres Kashnikow
*Attorney, Agent, or Firm*—Parkhurst & Oliff

[57] ABSTRACT

A group of nozzles are submerged in a tank of liquid to produce convergent-divergent vortices and cavitation in a liquid which in turn produce acoustic vibrations which assist in cleaning articles placed in the liquid, or in emulsifying a mixture of liquids. Each such nozzle comprises a body, with a central axis, an inlet at one end for supply of liquid under pressure thereto, and a plurality of discrete outlet ports at the other end transversely spaced from the central axis, the axes of the ports converging externally of the body towards the central axis whereby liquid supplied to the inlet under pressure emerges from the outlets in discrete jets directed to pass close to but not to intersect the central axis of the body.

17 Claims, 5 Drawing Figures

FLUID OPERATED NOZZLES FOR GENERATION OF VIBRATIONS IN LIQUIDS

This is a continuation of application Ser. No. 940,283, filed Sept. 7, 1978, now abandoned.

The present invention relates to fluid-operated nozzles for the generation of vibration in liquids. Throughout this specification such nozzles are referred to as "hydro-oscillatory" nozzles.

One form of hydro-oscillatory nozzle is known from U.K. Pat. No. 1,475,307, in which a vortex flow is generated in chambers inside a nozzle and emerges from the nozzle through a restricted outlet. The pressure or flow rate of the fluid in the nozzle is adjusted such that the fluid is acoustically agitated and cavitation is produced. When such nozzles are operated submerged in a tank of fluid the acoustic vibrations from the fluid in the nozzle greatly assist cleaning of articles immersed in the fluid in the tank.

Although such nozzles operate satisfactorily, the cavitation in the fluid causes wear on components of the nozzle.

An object of the present invention is to provide a hydro-oscillatory nozzle in which this problem is significantly reduced or eliminated.

A further object of the invention is to provide a hydro-oscillatory nozzle which is relatively cheap to produce.

According to the present invention a hydro-oscillatory nozzle comprises a body having a central axis, an inlet for the supply thereto of a liquid under pressure, and at least two discrete outlet ports radially spaced from said axis, the ports having axes which converge externally of the body in the direction of the central axis of the body whereby liquid supplied under pressure to the interior of the body emerges from the ports in discrete jets directed to pass close to, but not to intersect, the central axis of the body.

By this means, when the nozzle is in use and submerged in a liquid, a vortex flow is produced in the liquid externally of the nozzle and this in turn produces cavitation and vibrations in the liquid. Since the vortex is now wholly formed externally of the nozzle, the wear on the nozzle surfaces exposed to the fluid flow is reduced and the life of the nozzle is increased.

The invention also includes apparatus for treating articles comprising a container for a treatment liquid and a plurality of hydro-oscillatory nozzles according to the invention disposed within the container together with the associated pump or pumps for supplying fluid under pressure to the nozzles.

The numbers, sizes and orientations of the outlet ports will be a matter of design choice for any given treatment apparatus as will be hereinafter described. In each case however, the axes of the ports will be "focussed" towards a point along the central axis of the body spaced from the nozzle. The words "focussed or focussing" as used in this specification in relation to the axes of the outlet ports, is intended to mean that extensions of the axes of the ports externally of the nozzle converge towards a point (the focussing point) on the central axis of the body, but do not interest the central axis, rather, they pass close by the central axis to the sides thereof to impart a swirling motion to the liquid and produce a vortex in the liquid.

The axes of the outlet ports may be arranged parallel to each other in one transverse plane while converging on the central axis, or may converge towards each other as well as towards the axis so that they cross over at the focussing point.

The nozzle outlet ports may be arranged in any convenient pattern, for example, on a single pitch circle, in a spiral array, or on two or more pitch circles, and the axes of the outlet ports may be focussed towards one or more points on the central axis of the nozzle.

In addition to the above described outlet ports the nozzle may have a central port having an axis aligned with the central axis of the nozzle.

The nozzle body may be divided into one or more chambers each having a fluid inlet and each having two or more outlet ports having axes directed towards a central axis of the respective chamber.

The cross-sectional shape of the outlet ports may be circular, elongated to form slots, or any other convenient shape.

In an alternative embodiment of the invention, the outlet ports are formed as elongate slots disposed parallel to each other and having longitudinal axes directed towards a point on the central axis of the body but passing on opposite sides of the central axis.

Examples of the invention will now be more particularly described with reference to the accompanying drawings in which.

Figure 1:
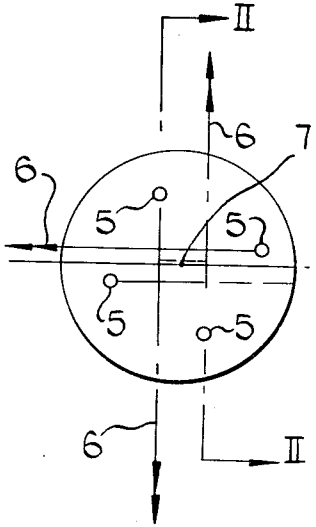
FIG. 1 is an end elevation of a nozzle according to the present invention.
Figure 2:
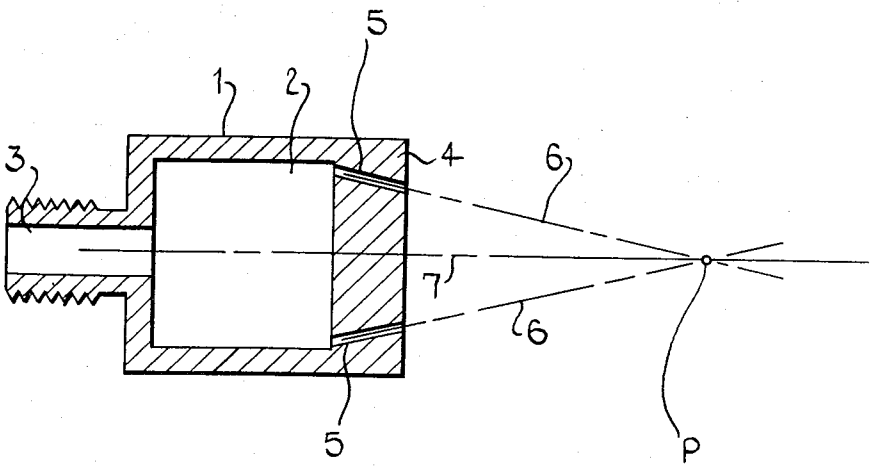
FIG. 2 is a sectional side elevation on the line II—II of FIG. 1.

Referring now to FIGS. 1 and 2 of the drawings the nozzle consists of a hollow body 1 having an inner chamber 2 which is supplied with liquid under pressure from an inlet 3 at one end. At the opposite end, an end plate 4 is provided having four outlet ports 5 which are of circular cross-section and which have longitudinal axes 6 inclined towards the central axis 7 of the body of the nozzle.

The inclination of the four axes 6 of the ports is such that they are "focussed" towards a point P on the central axis 7, as seen in the side elevation, but at the point P are laterally spaced from the axis 7. The fluid jets produced by the outlet ports thus pass close to the central axis and produce a convergent-divergent vortex in a liquid in which the nozzle is submerged. It is the unstable nature of this vortex which give rise to vibrations in the liquid.

The lateral separation of the axes 6 and 7 is approximately twice the diameter of the ports, but other distances may be effective in producing a vortex flow of sufficient energy to produce the vibration. In general, the offset of the ports from the transverse axis of the body will be in the range between one half and four times the port diameter except in the case in which the axes of the ports are angled in both transverse directions in which case the ports could be on the transverse axes.

The angle of inclination of the port axes to the central axis of the body may be in the range between 20° and 70° but will typically be between 40° and 50°.

The minimum number of outlet ports is clearly two, but this number would only be effective in a small nozzle application. Typically four or six outlet ports will be used but more could be used on larger installations. The diameter of the outlet ports is typically about 0.080 inch but again this will depend on the nozzle size, the number of ports and the pressure of the liquid supply to the nozzle.

A minimum pressure is needed to establish the vortex flow pattern and this will once again vary depending on the installation. The pressure and flow rate together with all the other parameters must be chosen consistent with producing a convergent-divergent vortex in the liquid in which the nozzle is submerged. Using the nozzle of the present invention a minimum pressure of about 35 psi (pounds per square inch) will produce as effective vortex flow, which means that relatively inexpensive pumping equipment producing pressures between 35 psi and, say, 100 psi can be used, although there is no upper limit on the pressure if very high frequency vibrations are needed.

The vibration of the liquid in which the nozzle is immersed may be either high or low frequency depending on the type or number of vortices formed, and may be used for cleaning or de-scaling articles immersed in the liquid in a cleaning tank, or may be used for mixing flows in a pipe line.

Figure 3:
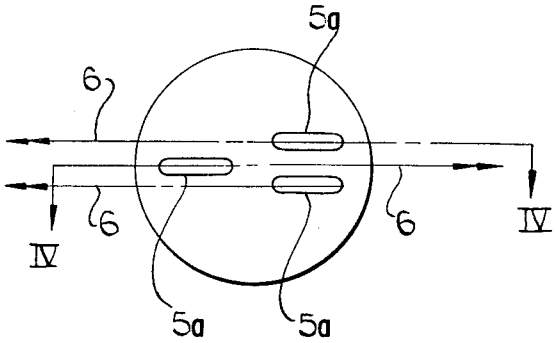
FIG. 3 is an end elevation of an alternative nozzle according ot the invention.
Figure 4:
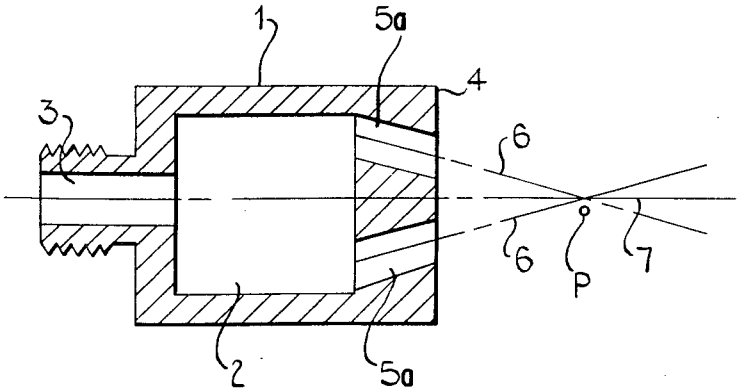
FIG. 4 is a sectional side elevation on the line IV—IV of FIG. 3.

An alternative nozzle construction is illustrated in FIGS. 3 and 4 in which similar parts are given the same reference numerals. In this construction the outlet ports 5*a* are elongated to form slots, all the side edges of which are parallel. Two slots are shown on one side of the axis 7 and one is shown on the other side, although other numbers and configurations of slots could be used, and the flows from the slots are focussed towards point P on the central axis 7. The two ports one side of the axis 7 are spaced from the axis by between one half and four times their width. This arrangement of the ports gives rise to flows travelling through a liquid in which the nozzle is immersed in opposite directions, which in turn produces vortices in the liquid.

Clearly, as described earlier, modifications may be made to the basic nozzle design shown in the Figures, for example multiple chambers 2, and different numbers, shapes and configurations of outlet ports, may be used to give more than one focussing point P.

In any of the nozzle configurations used the base plate 4 may be detachable from the body to enable the outlet port arrangement to be variable, depending on the nozzle application, by substitution of different base plates.

Figure 5:
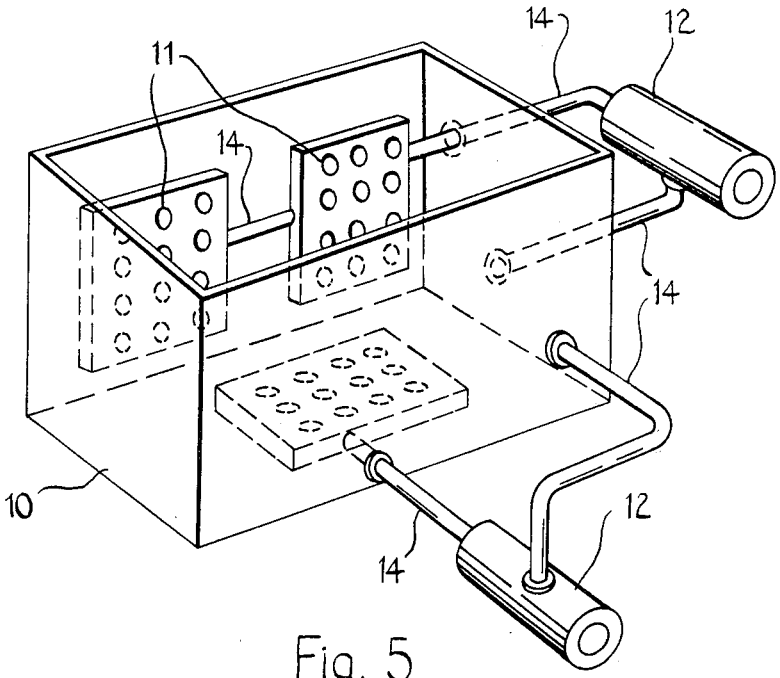
FIG. 5 is a diagrammatic layout of a treatment apparatus including nozzles of the present invention.

FIG. 5 illustrates a typical apparatus which may be used for cleansing articles e.g. by de-greasing or de-scaling. The apparatus consists of a liquid tank 10 which in use will contain a chemical cleansing solution depending on the treatment to be made. Connected to both sides and the bottom of the tank are nozzles 11 of the present invention in banks of any suitable number, e.g. twelve as illustrated. Only three banks of nozzles are shown but any suitable number may be used. The banks of nozzles are shown fixed and are "plumbed in" to a liquid supply which is circulated from the liquid in the tank by means of a pair of pumps 12 and pipework 14. Clearly the material from which the nozzles are made must be compatible with the liquid to avoid adverse reactions between the two.

As an alternative, the banks of nozzles may be adjustable and flexible pipes may be used to allow the disposition of the nozzles to be changed depending on the shapes of articles to be cleaned.

The nozzles may also be individually adjustable on their mounting any may be replaceably mounted, for example, by a screw thread on the inlet portion 3.

The nozzles of the invention can be used for other applications where vibratory motion in a liquid flow is required e.g. in emulsifying liquids.

I claim:

1. A method of creating ultrasonic vibrations in a liquid comprising:

producing a plurality of discrete flows in the liquid; and directing the flows such that they converge to come near to each other and to pass but do not intersect, such that a convergent-divergent vortex is produced in the liquid sufficient to cause cavitation to occur within the vortex.

2. A method according to claim 1 wherein the flows are created by issuing liquid under pressure from a chamber through a plurality of discrete outlet ports into the liquid, and the outlet ports are directed so as to make the jets converge to come near to and to pass, but not to intersect, each other whereby to produce a convergent-divergent vortex in the liquid.

3. A method according to claim 1 wherein at least two of the converging flows make an angle between them greater than or equal to substantially 40° when viewed from a direction perpendicular to a plane parallel to the flows.

4. An apparatus for ultrasonic treatment of articles, the apparatus comprising:

a container;

a treatment liquid contained in the container; and ultrasonic means for producing a plurality of flows in the liquid and directing the flows such that they converge to come near to each other and to pass, but do not intersect, such that a convergent-divergent vortex is produced in the liquid sufficient to cause cavitation to occur within the vortex.

5. An apparatus according to claim 4 wherein the ultrasonic means comprises at least one body having:

a chamber;

an inlet for supply to the chamber of the liquid under pressure; and a plurality of discrete outlet ports from the chamber, the outlet ports having axes which converge to come near to and to pass, but not to intersect, each other externally of the body whereby liquid supplied under pressure to the inlet emerges from the outlet ports in discrete, nonintersecting jets which produce a convergent-divergent vortex in the liquid sufficient to cause cavitation to occur within the vortex.

6. An apparatus according to claim 5 wherein the body has a central axis and the downstream ends of the outlet ports are spaced from the central axis by distances between one half and four times the width of the outlet ports.

7. An apparatus according to claim 5 wherein the body has a central axis and at least two of the outlet ports have axes which are in parallel planes parallel to and equally spaced from the central axis.

8. An apparatus according to claim 5 wherein the body has three outlet ports, two of which have parallel axes and the third of which has an axis which converges to come near to and to pass between the two parallel axes whereby to produce two oppositely sensed vortices in the liquid.

9. An apparatus according to claim 5 wherein the outlet ports are circular in cross-section.

10. An apparatus according to claim 5 wherein the outlet ports are elongate in cross-section.

11. An apparatus according to claim 5 wherein at least two of the outlet ports have axes which make an angle between them greater than or equal to substantially 40° when viewed from a direction perpendicular to a plane parallel to the axes.

12. A hydro-oscillatory nozzle for use in producing ultrasonic vibrations in a liquid in which the nozzle is submerged, the nozzle being connected to a source of fluid under pressure and comprising a body having:

a chamber;

an inlet for supply to the chamber of liquid under pressure; and a plurality of discrete outlet ports from the chamber, the outlet ports having axes which converge to come near to and to pass, but not to intersect, each other externally of the body, at least two of the axes making an angle between them greater than or equal to substantially 40° when viewed from a direction perpendicular to a plane parallel to the axes, thereby producing a convergent-divergent vortex in the liquid, wherein the fluid flow from the nozzle comprises a plurality of convergent, nonintersecting jets, with the properties of the fluid, characteristics of the fluid flow, and the nozzle configuration sufficiently interrelated to cause cavitation to occur within the vortex.

13. A nozzle according to claim 12 wherein the body has a central axis and the downstream ends of the outlet ports are spaced from the central axis by distances between one half and four times the width of the outlet ports.

14. A nozzle according to claim 12 wherein the body has a central axis and at least two of the outlet ports have axes which are in parallel planes parallel to and equally spaced from the central axis.

15. A nozzle according to claim 12 wherein the body has three outlet ports, two of which have parallel axes and the third of which has an axis which converges to come near to and to pass between the two parallel axes whereby to produce two oppositely sensed vortices in the liquid.

16. A nozzle according to claim 12 wherein the outlet ports are circular in cross-section.

17. A nozzle according to claim 12 wherein the outlet ports are elongate in cross-section.

* * * * *